US007674098B2

(12) United States Patent
Lifson

(10) Patent No.: US 7,674,098 B2
(45) Date of Patent: Mar. 9, 2010

(54) SCROLL COMPRESSOR WITH VAPOR INJECTION AND UNLOADER PORT

(75) Inventor: Alexander Lifson, Manlius, NY (US)

(73) Assignee: Scroll Technologies, Arkadelphia, AR (US)

( * ) Notice: Subject to any disclaimer, the term of this patent is extended or adjusted under 35 U.S.C. 154(b) by 672 days.

(21) Appl. No.: 11/593,732

(22) Filed: Nov. 7, 2006

(65) Prior Publication Data

US 2008/0107555 A1 May 8, 2008

(51) Int. Cl.
*F03C 2/00* (2006.01)
*F03C 4/00* (2006.01)
*F04C 2/00* (2006.01)

(52) U.S. Cl. ..... 418/15; 418/55.1; 418/55.5; 418/57; 417/310; 417/440; 62/196.1; 62/196.3

(58) Field of Classification Search ..... 418/15, 418/55.1–55.6, 57; 417/310, 440; 62/505, 62/510, 513, 196.1, 196.3
See application file for complete search history.

(56) References Cited

U.S. PATENT DOCUMENTS 6,042,344 A * 3/2000 Lifson ..... 417/310
6,474,087 B1 * 11/2002 Lifson ..... 62/513
7,228,710 B2 * 6/2007 Lifson ..... 62/513
7,278,832 B2 * 10/2007 Lifson et al. ..... 418/55.1
2004/0184932 A1 * 9/2004 Lifson ..... 417/310

* cited by examiner

*Primary Examiner*—Theresa Trieu
(74) *Attorney, Agent, or Firm*—Carlson, Gaskey & Olds

(57) ABSTRACT

A scroll compressor is provided with a passage for providing both an unloader function and an economizer injection function. This common passage communicates with separate ports. The ports that are exclusively used for by-pass unloading operation are open only during by-pass unloading operation, but blocked off by a check valve during vapor injection operation. The other, normally smaller vapor injection ports are open for both vapor injection and by-pass unloading operation. By utilizing these two sets of ports, a smaller total port area is provided for vapor injection operation and a much larger total open port area for by-pass operation. The different open port areas for by-pass unloading operation and vapor injection operation allows optimization of compressor operation at both of those regimes of operation.

8 Claims, 2 Drawing Sheets

SCROLL COMPRESSOR WITH VAPOR INJECTION AND UNLOADER PORT

BACKGROUND OF THE INVENTION

This application relates to a scroll compressor wherein one set of ports is utilized for both injecting vapor refrigerant into the compressor and for compressor unloading by directing vapor refrigerant from the compressor intermediate compression point to compressor suction, and wherein the other separate set of ports is utilized only for compressor unloading.

Scroll compressors are becoming widely utilized in refrigerant compression applications. In a scroll compressor, first and second scroll members each have a base and a generally spiral wrap extending from the base. The wraps of the two scroll members interfit to define compression chambers. One of the two scroll members is caused to orbit relative to the other, and as they orbit relative to each other, refrigerant is trapped within compression chambers defined between the wraps. As the orbiting scroll moves through an orbiting cycle, the size of these compression chambers is reduced and the entrapped refrigerant is compressed.

There are many optional features which are utilized in refrigerant compression applications, and in scroll compressors. In one optional feature, when there is a reduced cooling capacity desired from a refrigerant system associated with the scroll compressor, the compressor may be "unloaded". When the compressor is unloaded, refrigerant may be tapped from the compression chambers through an open unloader valve and back to a suction port leading into the compressor. In this manner, the amount of compressed refrigerant is reduced, and the capacity of the associated refrigerant system is similarly reduced.

In another optional feature, when additional capacity is desired, an economizer cycle may be actuated. With an economizer cycle, refrigerant downstream of a condenser is tapped from a main refrigerant flow line and the tapped refrigerant is expanded. The tapped refrigerant passes in a heat transfer relationship with the main refrigerant line in an economizer heat exchanger, thereby sub-cooling the main refrigerant flow. The tapped refrigerant is injected into an intermediate compression port or set of ports in the compressor.

There is a prior art construction which provides both the unloader and economizer functions through to the same flow passage in the non-orbiting scroll member. In this structure, the economizer injection passage is also connected to the unloader line which selectively communicates the economizer injection passage back to the suction line. The economizer injection passage can be kept open or shutoff, with the shut off device installed in the economizer line between the condenser and the unloader line. Separate flow control devices control the operation of both the economizer function and the unloader. To perform vapor injection economized function or by-pass of the flow back to suction, there is normally a passage that extends through the base of the non-orbiting scroll, and into ports leading into the compression chambers.

In the prior art, there have been compromises with regard to the size and position of these ports. For optimum economizer operation (vapor injection), it is desirable to have relatively small ports. If the ports for injection are selected to be too large, the efficiency of the compression cycle would drop off. On the other hand, for optimum unloader operation, it is normally desirable to select the ports to be as large as possible as permitted by the compressor dimensional envelope.

Thus, in the prior art, there have been compromises between these two goals, when selecting the size of these ports, since the same ports were used for both vapor injection and by-pass unloading operation.

SUMMARY OF THE INVENTION

In the disclosed embodiment of this invention, a single passage communicates through a compressor shell, and into a passage in non-orbiting scroll member. The passage leads to both economizer ports, and bypass ports which extend through a base of the non-orbiting scroll member to communicate with the compression chambers. The economizer ports are preferably positioned more adjacent a mid-way portion of the compression cycle (however under some circumstances it might be more desirable to position them closer to the suction side), while the separate bypass holes are positioned closer to the suction side. The bypass holes are preferably of a larger cross-sectional area than the economizer holes. Having a larger size by-pass ports optimizes compressor performance at by-pass unloading operation, as larger ports permit more flow to by-pass back to suction than smaller ports. Also the parasitic throttling flow losses are reduced with larger by-pass ports. Further, the bypass holes are preferably associated with the check valve such that the vapor being injected into the economizer injection holes does not pass into the bypass holes. However the by-pass flow can pass through an injection port and by-pass dedicated port (when the flow is by-passed the check valve is open). In this case the by-pass process is further optimized because the amount of by-pass flow is further increased as the by-pass flow can pass through both of these openings.

With the present invention, the scroll compressor designers can design the size and location of the ports to be optimum for each function.

These and other features of the present invention can be best understood from the following specification and drawings, the following of which is a brief description.

DETAILED DESCRIPTION OF THE PREFERRED EMBODIMENT

Figure 1:
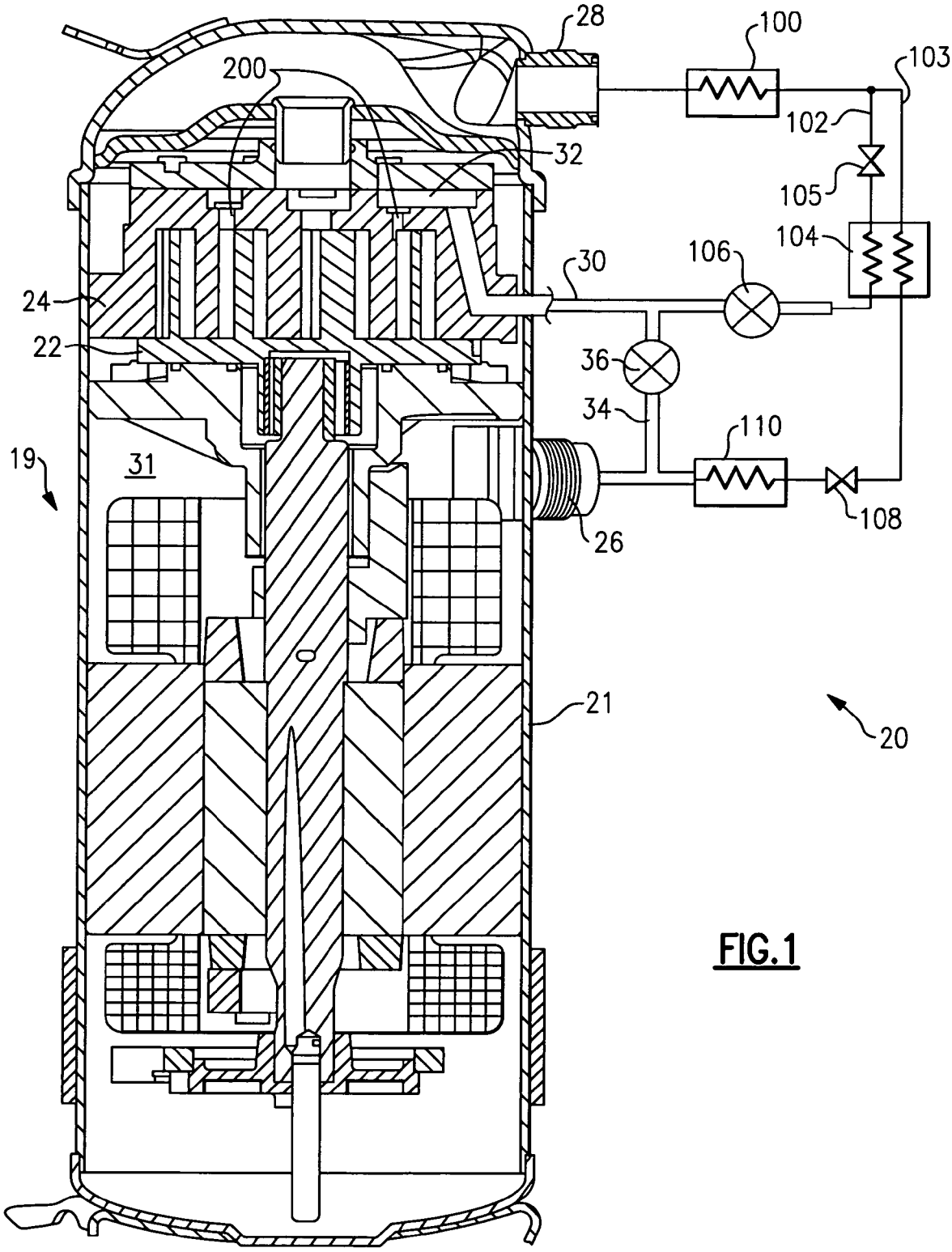
FIG. 1 is a cross-sectional view of a scroll compressor incorporating the present invention.

A refrigerant system 20 is illustrated in FIG. 1 having a compressor 19 with a compressor shell 21. The compressor is a scroll compressor having an orbiting scroll member 22 and a non-orbiting scroll member 24. A suction line 26 delivers a refrigerant into a chamber 31 within the compressor shell 21. As known, refrigerant is compressed between the orbiting scroll member 22 and non-orbiting scroll member 24, and delivered outwardly of the shell 21 through a discharge line 28. An economizer injection line 30 communicates with a passage 32 extending through a base of the non-orbiting scroll member 24. As further shown, a line 34 communicates the passage 30 back to the suction line 26. An unloader valve 36 positioned on this line 34 selectively blocks or allows refrigerant to flow from the compression chamber outwardly and back into the suction line 26.

A condenser 100 is positioned downstream of discharge port 28. A tap 102 taps a portion of a refrigerant from a main refrigerant line 103, and expands that tapped refrigerant in an expansion device 105. The tapped refrigerant passes in heat transfer relationship with the refrigerant in the main flow line 103 in an economizer heat exchanger 104. The tapped refrigerant is returned back through a valve 106 and into the line through the passage 30. While the flow of the tapped refrigerant 102 and main refrigerant flow 103 are shown in the same direction through the economizer heat exchanger 104, in practice they may be in counter-flow directions.

Downstream of the economizer heat exchanger 104, the main refrigerant flow line passes through an expansion device 108, an evaporator 110, and back to the suction line 26.

Figure 2:
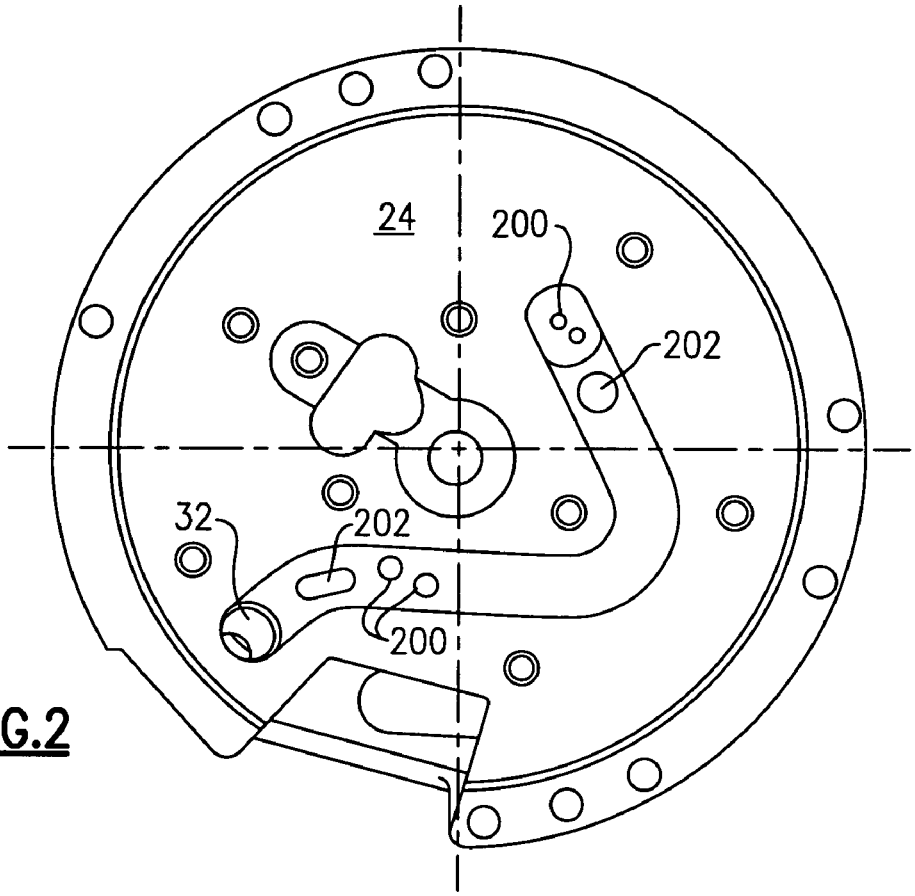
FIG. 2 is a top view of the non-orbiting scroll according to the present invention.

As shown in FIGS. 1 and 2, the passage 32 communicates with economizer injection ports 200. As shown in FIG. 2, there are can be a pair (or multiple ports) of ports 200 or a single port associated with two distinct locations in the base of the non-orbiting scroll 24. Further, unloader ports 202 are shown in this figure. As shown in this Figure, the locations of the ports 202 are closer to the outer portions of the wraps of the orbiting and non-orbiting scroll members, and thus closer to a suction location than are the economizer holes 200. As the orbiting scroll orbits, the by-pass unloader ports can be exposed to both chamber 31 at suction pressure as well as partially compressed gas between the fixed scroll 24 and orbiting scroll 22. If the by-pass unloader ports are positioned further into the compression process, they may be only exposed to the partially compressed refrigerant and be essentially isolated form the chamber 31.

Figure 3:
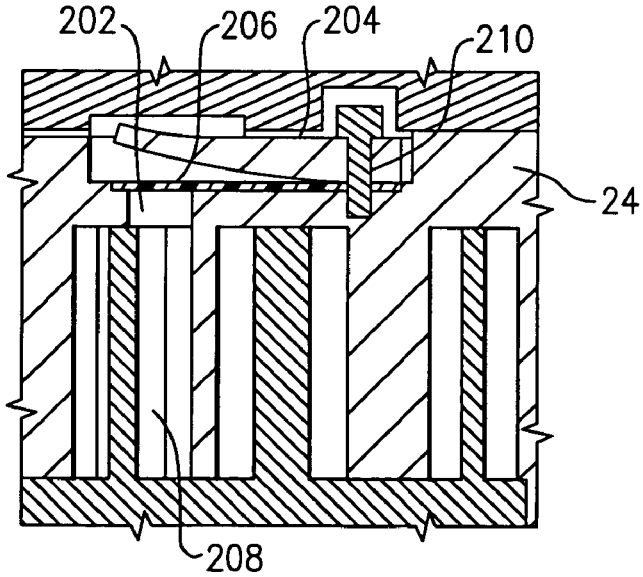
FIG. 3 shows another feature of the present invention.

As shown in FIG. 3, the unloader holes 202 are associated with a valve stop 204, bolt 210 holding the valve stop 204, and a reed valve 206. During the unloading operation, the pressure inside the scroll elements is higher then the suction pressure, which opens the reed valve and permits a portion of the flow from the scroll compression pockets to by-pass back to suction through passages 202. Some additional flow is also by-passed through open passages 200, which are always open. On the other hand when the vapor injection process is engaged, pressure in the economized passage is higher then pressure inside the scroll compression pockets, thus the reed valve is closed preventing vapor injection from being injected through the blocked off passages 202. The vapor is then only injected through passages 200, whose size and location is specifically selected to optimize the amount of vapor-injected flow.

By utilizing the dual port arrangement, where a check valve covers one set of ports, the present invention is able to provide an optimum design for these types of operation. The prior art compromises as set forth above are thus eliminated.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A scroll compressor comprising:

a first scroll member having a base and a generally spiral wrap extending from its base;

a second scroll member having a base and a generally spiral wrap extending from its base, the base of said first and second scroll members interfitting to define compression chambers, said second scroll member being driven to orbit relative to said first scroll member;

a suction line for communicating refrigerant into a compressor shell for said compressor, and a discharge line for communicating refrigerant outwardly of said shell;

an economizer injection line for injecting a vapor refrigerant back into the compression chambers from an economizer circuit, said economizer injection line passing through said base of said first scroll member and communicating with at least one economizer port for injecting the vapor refrigerant into said compression chambers; and an unloader line for selectively communicating said economizer injection line back to said suction line, said unloader line being associated with an unloader valve, and at least one unloader port being provided in said first scroll member and when said unloader valve is opened, to communicate refrigerant from said compression chambers through said unloader port, into said economizer injection line, into said unloader line and to said suction line, said unloader port and said economizer port being distinct ports, and, when said unloader valve is open, refrigerant passing from said compression chambers, through said unloader port, and through said economizer port, and into said unloader line, but refrigerant not passing into said compression chambers through said unloader port when said economizer injection line is passing refrigerant into said compression chambers.

2. The scroll compressor as set forth in claim 1, wherein said economizer port is positioned further into a compression cycle than is said unloader port.

3. The scroll compressor as recited in claim 1, wherein said at least one economizer port is of a smaller cross-sectional area than at least one said unloader port.

4. The scroll compressor as recited in claim 1, wherein a flow resistance of at least one of said economizer port is larger than a flow resistance of at least one of said unloader ports.

5. A scroll compressor comprising:

a first scroll member having a base and a general1y spiral wrap extending from its base;

a second scroll member having a base and a generally spiral wrap extending from its base, the base of said first and second scroll members interfittig to define compression chambers, said second scroll member being driven to orbit relative to said first scroll member;

a suction line for communicating refrigerant into a compressor shell for said compressor, and a discharge line for communicating refrigerant outwardly of said shell;

an economizer injection line for injecting a vapor refrigerant back into the compression said first scroll member and communicating with at least one economizer port for injecting the chambers from an economizer circuit, said economizer injection line passing through said base of vapor refrigerant into said compression chambers;

an unloader line for selectively communicating said economizer injection line back to said suction line, said unloader line being associated with an unloader valve, and at least one unloader port being provided in said first scroll member and when said unloader valve is opened, to communicate refrigerant from said compression chambers through said unloader port, into said economizer injection line, said unloader line and to said suction line, said unloader port and said economizer port being distinct ports;

said economizer port being positioned further into a compression cycle than is said unloader port; and there are two of said unloader ports, and two of said economizer ports.

6. A scroll compressor comprising:

a first scroll member having a base and a generally spiral wrap extending from its base;

a second scroll member having a base and a generally spiral wrap extending from its base, the base of said first and second scroll members interfitting to define compression chambers, said second scroll member being driven to orbit relative to said first scroll member;

a suction line for communicating refrigerant into a compressor shell for said compressor, and a discharge line for communicating refrigerant outwardly of said shell;

an economizer injection line for injecting a vapor refrigerant back into the compression chambers from an economizer circuit, said economizer injection line passing through said base of said first scroll member and communicating with at least one economizer port for injecting the vapor refrigerant into said compression chambers;

an unloader line for selectively communicating said economizer injection line back to said suction line, said unloader line being associated with an unloader valve, and at least one unloader port being provided in said first scroll member and when said unloader valve is opened, to communicate refrigerant from said compression chambers through said unloader port, into said economizer injection line, into said unloader line and to said suction line, said unloader port and said economizer port being distinct ports;

a check valve closes off flow from said economizer injection line into said compression chambers through said unloader port, said check valve opens to allow flow of refrigerant from said compression chambers, through said unloader port, and into said economizer injection line.

7. A scroll compressor comprising:

a first scroll member having a base and a generally spiral wrap extending from its base;

a second scroll member having a base and a generally spiral wrap extending from its base, the base of said first and second scroll members interfitting to define compression chambers, said second scroll member being driven to orbit relative to said first scroll member;

a suction line for communicating refrigerant into a compressor shell for said compressor, and a discharge line for communicating refrigerant outwardly of said shell;

an economizer injection line for injecting a vapor refrigerant back into the compression chambers from an economizer circuit, said economizer injection line passing through said base of said first scroll member and communicating with at least two economizer ports for injecting the vapor refrigerant into said compression chambers;

an unloader line for selectively communicating said economizer injection line back to said suction line, said unloader line being associated with an unloader valve, unloader ports provided in said first scroll member and when said unloader valve is opened, to communicate refrigerant from said compression chambers through said unloader ports, into said economizer injection line, into said unloader line and to said suction line, said unloader ports and said economizer ports being distinct ports, said economizer port positioned further into a compression cycle than said unloader port, said economizer ports being of a smaller cross-sectional area than said unloader ports; and a check valve closing off flow from said economizer injection line into said compression chambers through said unloader port, said check valve opening to allow flow of refrigerant from said compression chambers, through said unloader port, and into said economizer injection line.

8. The scroll compressor as recited in claim 7, wherein when said unloader valve is open, refrigerant passing through said economizer port, into said economizer injection line, said unloader line and to said suction line.

* * * * *